United States Patent [19]

Stahlecker et al.

[11] Patent Number: 4,612,764

[45] **Date of Patent: * Sep. 23, 1986**

[54] CONDITIONING ARRANGEMENT FOR OPEN-END FRICTION SPINNING MACHINE

[75] Inventors: Hans Stahlecker, Haldenstrasse 20, 7334 Süssen; Fritz Stahlecker, Josef-Neidhart-Strasse 18, 7347 Bad Überkingen, both of Fed. Rep. of Germany

[73] Assignees: Hans Stahlecker; Fritz Stahlecker, both of Fed. Rep. of Germany

[ * ] Notice: The portion of the term of this patent subsequent to May 7, 2002 has been disclaimed.

[21] Appl. No.: 657,514

[22] Filed: Oct. 4, 1984

[30] Foreign Application Priority Data

Oct. 7, 1983 [DE] Fed. Rep. of Germany ..... 3336591

[51] Int. Cl.[4] ..... D01H 7/885; D01H 1/20

[52] U.S. Cl. ..... 57/401; 57/301; 57/104

[58] Field of Search ..... 57/264, 300, 301, 400, 57/401

[56] References Cited

U.S. PATENT DOCUMENTS

| | | | |
|---|---|---|---|
| 3,895,483 | 7/1975 | Grau | 57/264 X |
| 4,007,457 | 2/1977 | Aeppli | 57/264 |
| 4,020,622 | 5/1977 | Lattion | 57/264 X |
| 4,084,398 | 4/1978 | Stahlecker et al. | 57/264 X |
| 4,137,699 | 2/1979 | Stahlecker et al. | 57/264 |
| 4,154,052 | 5/1979 | Alston | 57/302 |
| 4,222,224 | 9/1980 | Raasch | 57/301 X |

*Primary Examiner*—Donald Watkins
*Attorney, Agent, or Firm*—Barnes & Thornburg

[57] ABSTRACT

An open-end friction spinning machine is disclosed which has a plurality of adjacently arranged spinning units, each spinning unit including two adjacently arranged friction rollers driven in the same rotational direction and forming a wedge-shaped yarn forming gap therebetween. At least the friction roller rotating out of the wedge-shaped gap exhibits a closed cover surface. To assure consistent predetermined yarn characteristics, friction roller conditioning devices are disclosed for conditioning the friction surfaces of the friction rollers with closed cover surfaces.

38 Claims, 9 Drawing Figures

Fig. 1
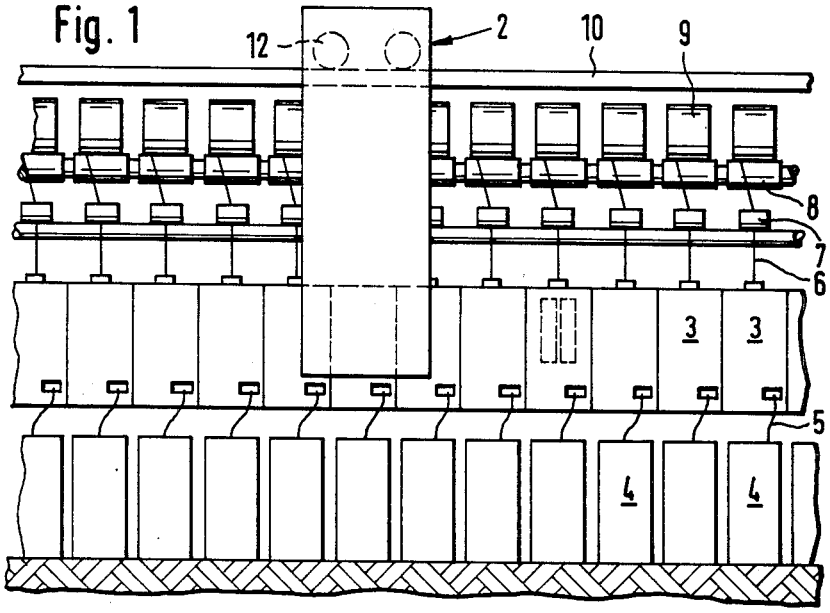
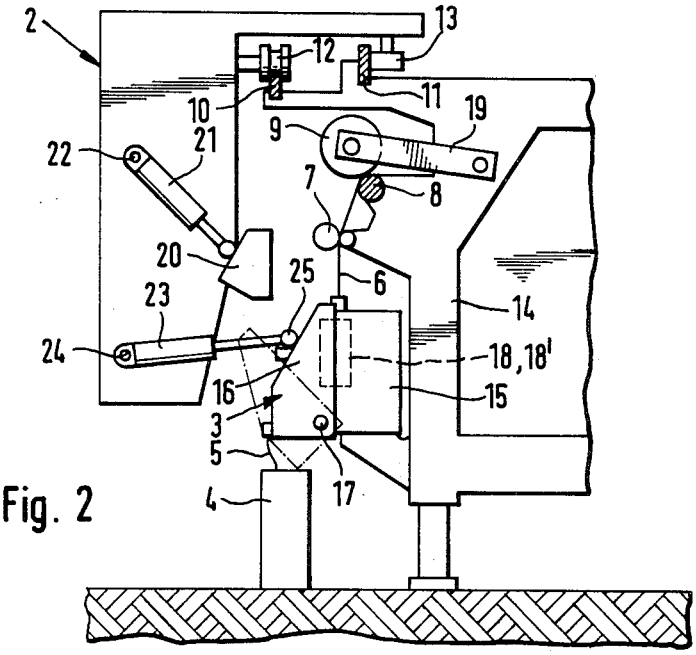
Fig. 2

CONDITIONING ARRANGEMENT FOR OPEN-END FRICTION SPINNING MACHINE

BACKGROUND AND SUMMARY OF THE INVENTION

The invention relates to an open-end friction spinning machine with a plurality of adjacently arranged spinning positions which each include two adjacently arranged friction rollers driven in the same rotational direction and forming a wedge-shaped gap of which at least one of the friction rollers rotates out of the wedge-shaped gap and exhibits a closed coating or cover surface.

An open-end friction spinning aggregate is described in German Published Unexamined Patent Application (DE-OS) 29 43 063 wherein the rollers rotating out of the wedge-shaped gap exhibit a closed cover or coating surface, while the roller rotating towards or into the wedge-shaped gap includes a perforated coating surface and a suction device within its interior region which is directed towards the wedge-shaped gap. In certain cases, an open end friction spinning machine is constructed from a plurality of such spinning units. The roller displaying a closed cover surface includes a coating or a layering of an elastic material, for example, natural or synthetic caoutchouc (India rubber). By using a roller with a closed cover surface, the structural costs are reduced since in such cases a second suction device becomes unnecessary and especially because the second roller would not need a perforation requiring substantial manufacturing expenditures. Practical tests, however, have shown that with such a device the quality of the yarn experiences substantial fluctuations, whereby a change in quality may result after relatively short or longer periods of time.

The invention is based upon the problem to so design an open-end friction spinning machine of the kind mentioned above so that a yarn of a consistent quality can be obtained.

This problem is solved according to the invention by providing one or several devices for the conditioning of the surfaces of at least those rollers with closed cover surfaces.

The invention is based, at least in part, on the knowledge established through tests that the change of yarn quality is caused by a substantial change in the friction characteristics of the rollers with closed cover surfaces, which surfaces preferably contain a non-metallic layer. Through the device or devices for conditioning the surfaces according to the present invention, constant friction characteristics of the rollers are obtained which then lead to a constant yarn quality.

According to a first preferred embodiment of the invention it is provided that each spinning unit is equipped with a device for conditioning the surfaces of the rollers with closed coating surfaces. These devices are preferably continuously driven so that the friction characteristics remain consistently constant. An electrostatic charge of the roller surfaces is advantageously avoided, for example, by providing the devices with a metallic conductor adjacent to the roller surfaces which is grounded.

In most cases, it is sufficient in practice according to other preferred embodiments of the invention to provide periodic conditioning of the surfaces of the rollers. According to one preferred embodiment it is provided that the roller conditioning devices of these spinning units are jointly operable by means of a central drive. Accordingly, another preferred embodiment is provided wherein the roller conditioning devices of the individual spinning units are selectively switched into operation by means of a maintenance device movable alongside the spinning machine. A central drive is thereby made unnecessary since activating the devices is assumed by the maintenance device which in most cases is already present for other machine maintenance operations.

According to another embodiment of the invention a maintenance device which is movable along the spinning machine is provided, the same being movable to the respective individual spinning units and including a device for conditioning the surfaces of at least the rollers with closed coating surfaces. According to certain preferred arrangements, it is provided that the movable maintenance device passes to the single spinning units in a predetermined time interval. Alternatively or in addition to this arrangement, preferred embodiments are contemplated wherein the movable maintenance device attends to a conditioning of the surfaces during a yarn break, or during a spool exchange, or prior to a start spinning after a machine operational stand still.

In certain embodiments of the invention it is provided that the device for conditioning includes a cleaning device movable to the surfaces of the rollers with closed shell surfaces. In many cases the cleaning alone already results in maintaining constant friction characteristics since thereby also the contaminations are removed which are carried by the supplied fibers, as for example dust, waxes or greases, or the like which will stick to the closed shell or cover surfaces and especially in the pores thereof. Cleaning devices are herewith contemplated having brush-like or scraping elements. It is also contemplated according to the invention to utilize cleaning devices which clean the surfaces of the rollers with a fluid or liquid cleaning detergent.

In certain preferred embodiments of the invention it is provided that the device for conditioning includes apparatus for applying a coating or layer covering the surfaces of the rollers at least in the area of the yarn formation region. These coatings or layers which are applied in the form of fluids or pastes, then determine the friction characteristics. Since these coatings wear out during the spinning operation, they have to be renewed from time to time according to the invention. It can thereby be advantageous to connect the application of such layers with a prior cleaning process at the surfaces of the rollers.

In certain preferred embodiments of the invention it is provided that the device for conditioning includes apparatus for roughening the surfaces of the rollers with closed cover surfaces. With such a roughening the surfaces of the rollers are brought into a desired, predetermined condition affecting the friction characteristics, which condition, especially through wear, will get less effective with a longer operational time period, and therefore has to be renewed at least from time to time according to the invention. It is advantageous according to certain preferred embodiments of the invention to combine this roughening with a prior cleaning and/or a prior application of a coating.

In certain embodiments of the invention it is provided that the device for conditioning includes apparatus for repair works and/or applying of impressions upon the surfaces of the rollers with closed shell surfaces. It is thereby taken into account that the surfaces will change through the wear, dependent upon the operational periods. Here again it is advantageous according to certain embodiments of the invention to also accommodate a combination of a cleaning process and/or application of a coat and/or a roughening process.

In certain embodiments of the invention it is provided that the device for conditioning includes apparatus for polishing the surfaces of the rollers with closed cover surfaces. Also by means of this arrangement, a certain consistent surface quality is obtained through which the friction characteristics are influenced in a predetermined manner. This polishing process may especially be connected with a prior, or also with a subsequent cleaning process according to the invention. It is also contemplated to attend to the polishing process after the application of a layer or coat.

Further objects, features, and advantages of the present invention will become more apparent from the following description when taken with the accompanying drawings which show, for purposes of illustration only, embodiments in accordance with the present invention.

BRIEF DESCRIPTION OF THE DRAWINGS

FIG. 1 is a partial, sectional view of an open-end friction spinning machine with a movable maintenance device viewed from the servicing side, of the type contemplated by the presention invention;

FIG. 2 is a cross sectional view through the open-end friction spinning machine of FIG. 1, showing the maintenance device in its operating position at a spinning position;

DETAILED DESCRIPTION OF THE DRAWINGS

Figure 3:
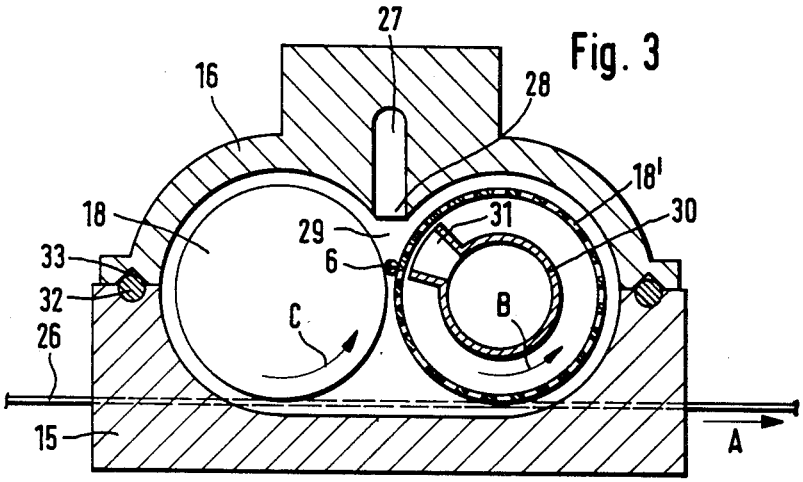
FIG. 3 is a cross sectional view through a spinning unit of the machine of FIGS. 1 and 2 in the area of the friction rollers forming the yarn formation region.

The open end friction spinning machine constructed in accordance with FIGS. 1 through 3 includes a plurality of adjacently arranged spinning units 3, which each are supplied with a fiber band 5 to be spun out of a can or bucket 4. The spinning units 3 twist the fiber band 5 to a yarn 6 which is drawn off by means of a yarn withdrawal device 7 and wound upon a take-up spool 9. The take-up spool 9 is driven by a grooved drum 8 and held by a pivotable bar or retainer 19 (FIG. 2).

Bearing housings 15 are arranged for each spinning unit at a machine frame 14, in which housing friction rollers 18 and 18' are housed. The rollers 18 and 18' are positioned parallel to each other to form a wedge-shaped gap 29 (FIG. 3) to which single fibers are supplied via a not further illustrated inlet and opening device. The single fibers are twisted to the yarn 6 within the wedge-shaped gap 29. Yarn 6 is drawn off in the longitudinal direction of the wedge-shaped gap 29 by means of the yarn withdrawal device 19. The rollers 18 and 18' are borne in a not further illustrated manner within the bearing housing 15. The rollers 18 and 18' are driven in the same rotational direction (arrow directions C and B of FIG. 3) by a moving tangential belt 26 (arrow direction A) engaging directly against their coating or cover surfaces. This tangential belt 26 drives all rollers 18 and 18' of the spinning units 3 at one machine side in a corresponding manner. Roller 18' rotating into the wedge-shaped gap 29 is arranged as a so-called suction roller, which means it exhibits a perforated shell surface and includes a suction insert 30 in its interior connected to a sub-pressure source, which suction insert 30 includes a suction slit 31 limited by protrusions which extend closely up to and adjacent the inner surfaces of roller 18'. Said suction slit 31 is directed towards the wedge-shaped gap 29 and also to the opening 28 of the fiber-feed channel 27. A suction air stream is thereby produced which holds the supplied fibers, as well as the forming yarn 6 in the wedge-shaped gap. Additionally the fiber transport in the fiber-feed channel 27 is at least supported by this suction air stream. The roller 18 rotating out of the wedge-shaped gap 29 (arrow direction C) displays a closed shell surface. This closed shell surface preferably includes a layer of synthetic material, especially a coat of synthetic or natural caoutchouc (rubber). For example, a coat or layer made from a material which is commonly known under the trademark "Vulkollan" has proven to be favorable.

The rollers 18 and 18' are covered by a cover-like housing part 16 at the side of the wedge-shaped gap 29 which serves as the yarn formation region. This housing part 16 also includes the fiber-feed channel 27. This cover-like component 16 includes prismatic longitudinal grooves 33 arranged at the bearing housing which support themselves and are centered by cylindrical guide rails or tracks 32.

The maintenance device 2, which is guided by wheels 12 and 13 at rails 10 and 11, is provided with a device 23 pivotable about an axle 24 which device, for example, consists of a hydraulic or pneumatic press which is carried by means of a roller head 25 linked into a corresponding counter element of the cover-like housing part, and through which the housing part 16 is pivotable about an axle into the position illustrated in FIG. 2 by dotted lines. The rollers 18 and 18' are thereby exposed. Additionally, the maintenance device 2 is provided with a device 20 for conditioning the surfaces of the roller 18 displaying a closed shell surface. This conditioning device is arranged by means of a device pivotable about an axle 22, for example, again a pneumatic or hydraulic press and movable to the opened spinning unit and the rollers 18 and 18'.

Figure 4:
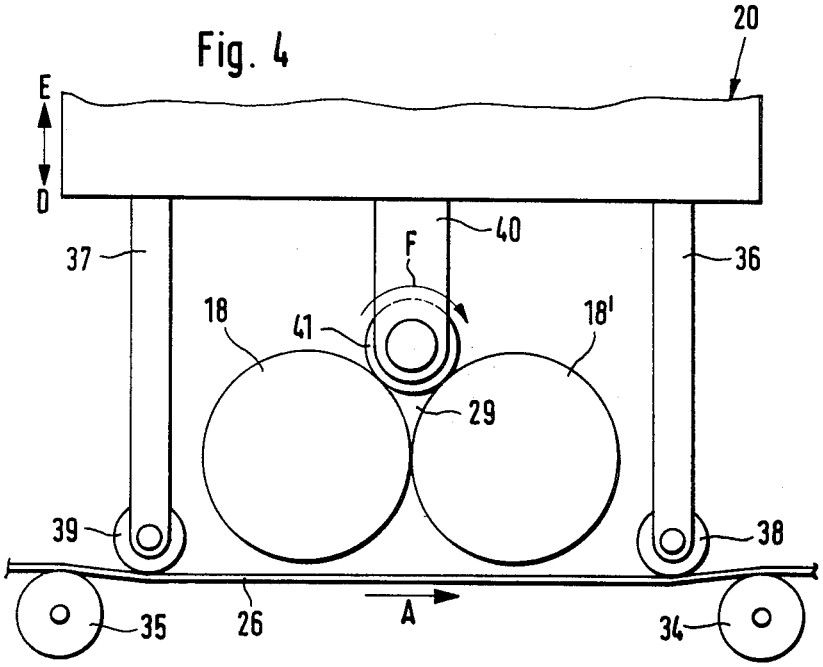
FIG. 4 is a schematic depiction of a device for interrupting the drive of the friction rollers of a spinning unit of the machine of FIGS. 1 and 2 with a simultaneous engagement of an auxiliary drive.

In order to condition the entire circumference, especially of roller 18, the same has to rotate during the conditioning process. In order not to have to operate with the relatively high spinning operational rotational speeds, the device 20 is provided with means for interrupting the operational drive, and with an auxiliary drive for the rollers 18 and 18'. The device 20 (FIG. 4) which is movable to and from the rollers 18 and 18' corresponding to the arrow direction D and E, is provided with two lift-off rollers 38 and 39 arranged upon levers or holders 36 and 37, by means of which the tangential belt 26 is moved off rollers 18 and 18'. The device 20 additionally includes a friction wheel 41 driven in arrow direction F which is movable to the two rollers 18 and 18' in the area of the wedge-shaped gap 29 upon a lever or holder 40. The drive direction of the friction wheel 41 is chosen in such a manner that the operational drive direction for the rollers 18 and 18' is also retained by the auxiliary drive.

The device 20 can contain further devices for conditioning the surface of roller 18, such as in accordance with the preferred embodiments of FIGS. 5 through 9 described below.

The device 20 (FIG. 5) is held at the bearing housing 15 by means of supports 42 which include prismatical guides 43 supported upon the cylindrical bars or tracks 32 of the bearing housing 15 and are thereby centered. A leaf-shaped spring-elastic strip 44 is attached to a pipe 47 by means of clamps 46, which strip 44 is elastically bent and lays upon the roller 18 with one side surface. The side of the leaf-shaped elastic strip facing or laying upon the surface of the roller 18 includes a friction layer or coat by means of which roller 18 is roughened at its surface while it is rotating in arrow direction C. At the pipe or duct 47 extending in the axial direction with respect to roller 18, several adjacently arranged jets 48 are provided for applying a treatment liquid or fluid upon the leaf-shaped elastic strip 44 and subsequently upon the surface of roller 18. A cleaning solution or liquid is supplied, for example, via the pipe or duct 47, which cleaning solution flushes away the particles loosened from the coat of the roller 18 during the roughening process. In a similar manner a paste-like or fluid means can be applied to the surface of the roller which itself hardens quickly and is distributed evenly by means of the leaf-like elastic strip.

Figure 5:
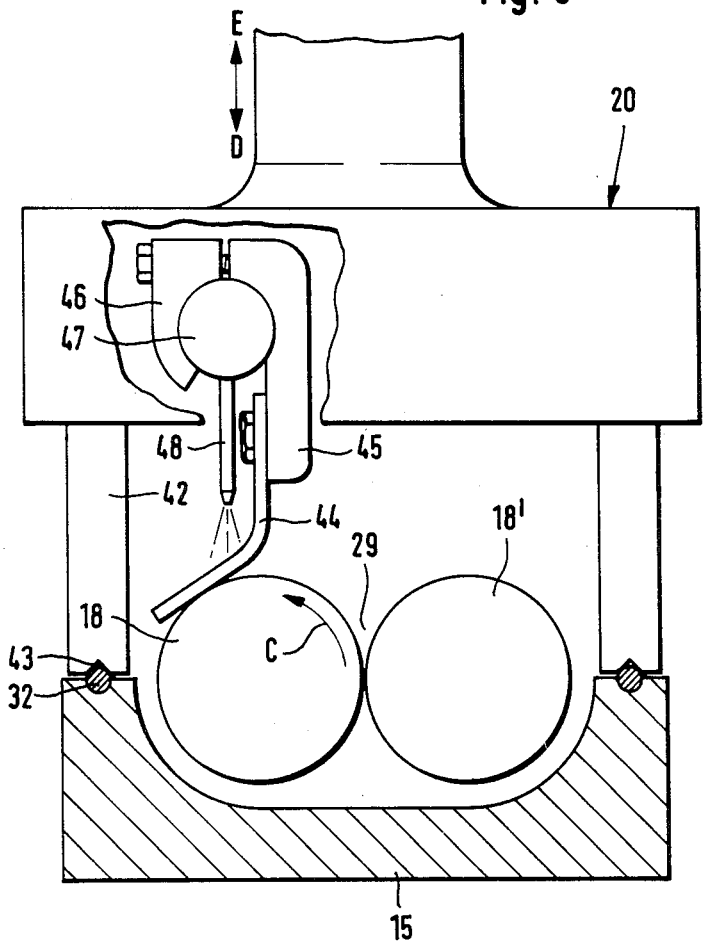
FIG. 5 is a cross-sectional schematic view taken in the direction of the friction rollers, showing a spinning unit and a conditioning device for conditioning the surface of a roller of a spinning unit, constructed in accordance with a preferred embodiment of the present invention.
Figure 6:
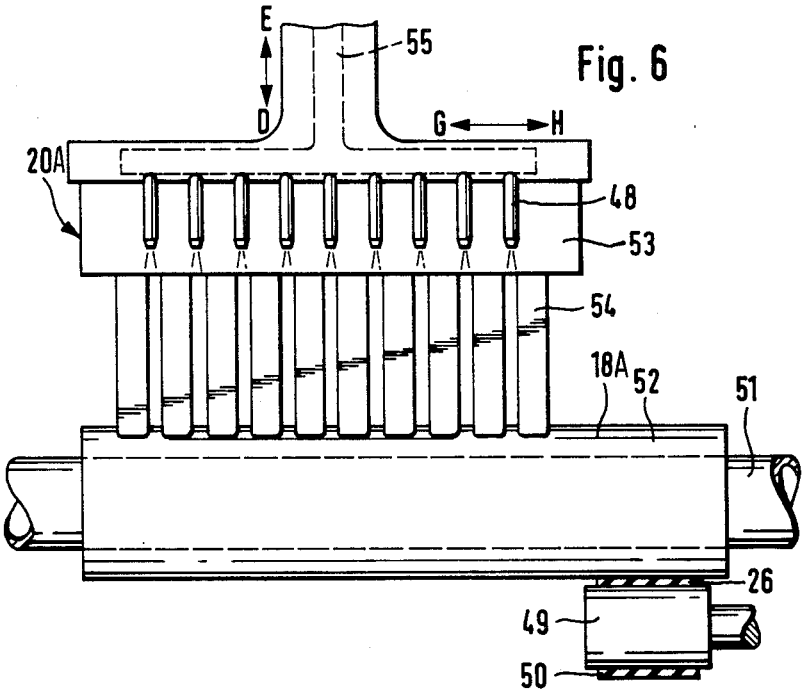
FIG. 6 is a schematic view taken in the radial direction of the friction rollers showing portions of a spinning unit and another preferred embodiment of a conditioning device for conditioning the surface of a friction roller.

In the embodiment according to FIG. 6 a plurality of flexible plastic strips 54 are fixedly attached to a bar or track 53 of the device 20A, which strips 54, similar to the leaf-shaped elastic strip 44 in FIG. 5, lay against the surface of roller 18A when device 20 is activated and moved in the direction of Arrow D. The roller 18A thereby consists of a tube 51 upon which a plastic layer 52 is pressed. The roller 18A is driven by tangential belt 26 rotating counter-clockwise to the coat or layer 52, which tangential belt is loaded by a friction roller 49 upon which the return driven run 50 of the tangential belt is reverse guided. The device 20A is additionally provided with a plurality of adjacently arranged application jets 48 in the longitudinal direction of the roller 18 through which a fluid or paste-like treatment means is supplied via a channel system 55. With this embodiment, a liquid or paste-like treatment means is supplied which not only dries quickly but also hardens, which again is distributed evenly to a determined thickness by the flexible plastic strips upon the surface of the roller 18A. It is thereby provided that the device 20A is driven to a changed motion corresponding to arrows G and H so that the entire axial length of the roller 18A is evenly conditioned.

Figure 7:
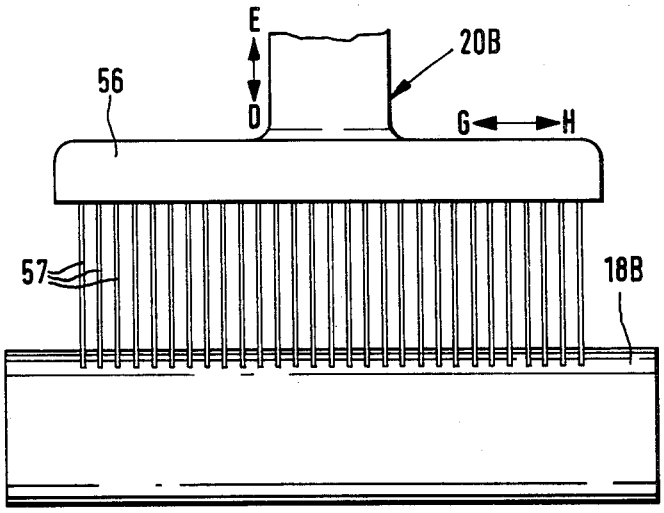
FIG. 7 is a view similar to FIG. 6, illustrating a brush-like device for conditioning the surfaces of the rollers constructed in accordance with another preferred embodiment of the invention.

With the embodiment according to FIG. 7, the device 20B includes a plurality of spring-like steel fingers or steel brushes 57 attached to a rake 56 for the conditioning process. Rake 56 is movable with respect to roller 18 corresponding to arrows E and D and is driven in a back and forth motion corresponding the arrows G and H. By means of these steel fingers or brushes 57 scratching the surface of roller 18B, the surface is cleaned and roughened in a desired manner. For example, the device 20B according to FIG. 7 could also be arranged at each spinning unit, especially at the side facing away from the fiber feeding or guiding wedge-shaped gap. This device can then also be moved with respect to the rollers 18 as depicted by arrows E-D and F-H as the need arises during the normal spinning operation. These motions are controlled simultaneously by a drive common to all spinning units at one machine side. In certain preferred embodiments, the rake is designed with a length which corresponds at least to the operable yarn formation zone axial length of the roller 18B, which means especially the opening area of the fiber-feed channel and also the then following yarn treatment zone through which the yarn being produced is drawn off. With such a construction the back and forth (arrows G and H) moving drive is made unnecessary.

Figure 8:
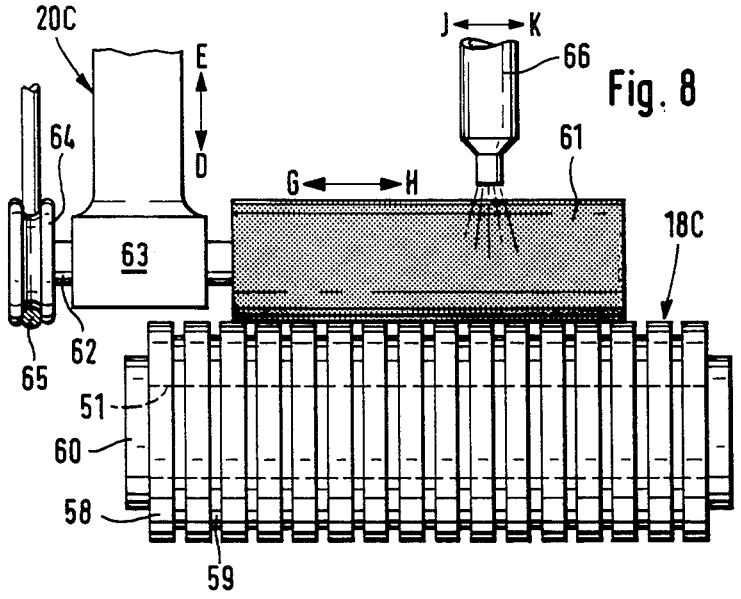
FIG. 8 is a view similar to FIGS. 6 or 7 of yet another preferred embodiment for conditioning the friction rollers, including means for polishing the surfaces of the rollers.

With the embodiment according to FIG. 8, a roller 18C is provided containing a closed cover or shell surface. Said surface is composed of a plurality of friction disks 58 between which intermediate rings 59 made out of metal are arranged respectively and which are stuck jointly upon an axle and held between face disks 60. The intermediate rings 59 exhibit a smaller diameter than the friction disks 58 so that only the friction disks 58 come into contact with the fibers and the yarn. Therefore only the friction disks are to be conditioned. A device 20C is provided for facilitating a polishing of the outer surfaces of the friction disks 58. The device 20C includes a roller 61 with a soft surface, a so-called mop roller, the axle 62 of which is borne in a holder or retainer 63 and is rotatably driven via a drive wheel 64 by means of a cord or rope. The roller 61 is soaked or impregnated with a polishing means, for example, an abrasive polishing paste which is guided to roller 61 via an application jet 66. The applicator jet 66 is driven in a back and forth motion as depicted by arrows I and K so that the abrasive paste is evenly distributed. Additionally, the device 20C which is moved to and away from the roller 18C as depicted by arrows D and E, is also driven in the direction of arrows G and H to a back and forth motion axially parallel with the roller 18C. Roller 61 extends parallel to roller 18C.

Figure 9:
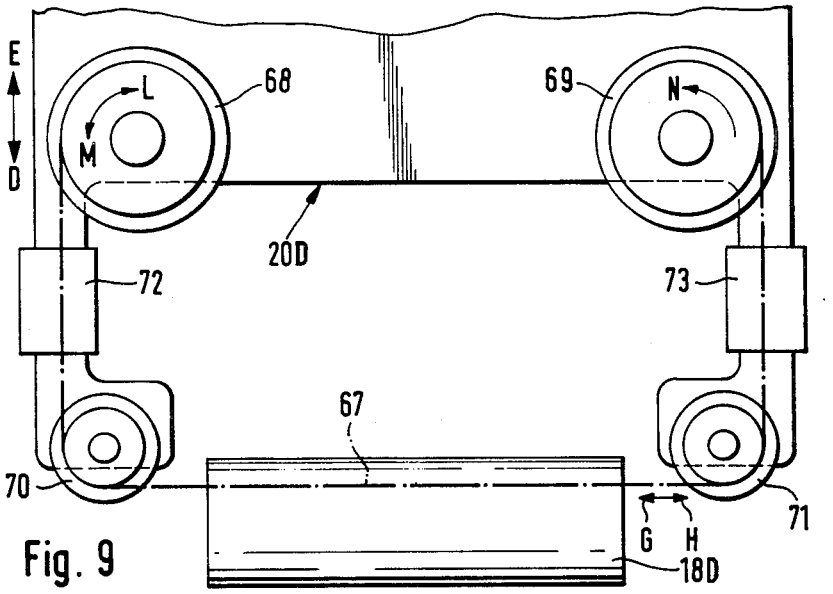
FIG. 9 is a schematic view of a further preferred embodiment of a device for conditioning the surfaces of rollers, by means of a cord or rope insertable into the wedge-shaped gap formed by the rollers.

The device 20D according to FIG. 9 includes a rope or cord 67 as a means for conditioning the surface of roller 18D (and also the roller 18'), which cord is inserted in the wedge-shaped gap between the two rollers 18 and 18' during positioning movement of the device 20D in the direction of arrow D. The cord or rope preferably can consist of a wire which is supplied with wire brushes so that the same is suitable for cleaning and roughening of the surface, especially the surface of roller 18 containing a coating. The cord or rope 67 is guided about two deflection rollers 70 and 71 in such a manner that the same is guided in the longitudinal direction of the wedge-shaped yarn forming gap. The ends of the cord 67 are attached to two wheels 68 and 69. The wheel 68 is driven in a back and forth motion as depicted by arrows L and M. The wheel 69 is loaded with a tension spring so that the treatment part is pulled back and forth in the wedge-shaped gap corresponding to arrows G and H whereby the tension spring of wheel 69 is responsible for constantly straightening and tensioning the treatment cord 67.

The device 20D here additionally includes two application devices 72 and 73 which the treatment cord 67 extends through by which a treatment means especially in the form of a paste or a wax, is supplied to the treatment cord 67. The device 20D according to FIG. 9 is preferably a component part of a movable maintenance device and is positioned adjacent respective spinning units in a manner corresponding to the other treatment devices described above, either in a constant time interval and/or after a yarn break and/or during a spool exchange and/or prior to a start spinning of the spinning machine from the stand still position. It is, however, also contemplated to provide for such a device 20D in accordance with FIG. 9 for each spinning unit respectively, which is then put into operation by a central drive at all spinning units jointly or by a maintenance device passing the spinning units. It is also contemplated to hold the device 20D in a constant operation at each spinning unit, especially if a treatment cord or rope 67 is provided which is not meant for roughening the surface of rollers 18D and 18', but is arranged to apply a coating determining the friction affect.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open end friction spinning apparatus including at least one spinning unit comprising:

adjacently arranged first and second friction rollers driven in the same rotational direction and forming a wedge-shaped yarn forming gap therebetween, and friction roller conditioning means for conditioning the friction surfaces of at least one of the friction rollers.

2. Apparatus according to claim 1, wherein the first friction roller rotating outwardly of the wedge-shaped gap is provided with a closed cover surface, and wherein said conditioning means includes means for conditioning the friction surfaces of the first friction roller.

3. Apparatus according to claim 2, wherein a plurality of said spinning units are arranged adjacent one another at a spinning machine.

4. Apparatus according to claim 3, wherein each spinning unit is provided with said conditioning means for conditioning the surfaces of the friction rollers.

5. Apparatus according to claim 4, comprising a central drive for jointly operating conditioning means of the spinning units.

6. Apparatus according to claim 3, comprising a movable maintenance unit including means for activating the conditioning means at the respective spinning units, said maintenance unit being movable in the longitudinal direction of the spinning machine to respective maintenance positions adjacent the respective spinning units.

7. Apparatus according to claim 3, comprising a maintenance unit which is movable in the longitudinal direction of the spinning machine to respective maintenance positions adjacent the respective spinning units, said conditioning means being accomodated on the maintenance unit.

8. Apparatus according to claim 6, wherein the conditioning means includes adjustable cleaning devices.

9. Apparatus according to claim 7, wherein the conditioning means includes adjustable cleaning devices.

10. Apparatus according to claim 3, wherein said conditioning means includes an arrangement for applying a layer or coating covering the surfaces of the friction rollers at least in the area of the yarn formation region.

11. Apparatus according to claim 3, wherein said conditioning means includes an arrangement for the roughening of the outer surfaces of the friction rollers.

12. Apparatus according to claim 3, wherein said conditioning means includes an arrangement for the reconditioning and/or application of depressions upon the surface of the respective first friction rollers.

13. Apparatus according to claim 3, wherein the conditioning means includes an arrangement for polishing the surfaces of the respective first friction rollers.

14. Apparatus according to claim 3, wherein the conditioning means includes a component part adjustably movable to adjacent the friction rollers, the length of which component part corresponds to the axial length of the friction rollers.

15. Apparatus according to claim 3, wherein the conditioning means includes a component part adjustably movable to the friction rollers, which component is driven in the axial direction of the rollers in a back and forth movement.

16. Apparatus according to claim 7, wherein the maintenance unit is provided with an arrangement for the interruption of the drive of the friction rollers and with an auxiliary drive adjustably movable to drivingly engage the friction rollers at the respective spinning units.

17. Apparatus for treating a friction roller surface of the kind usable in a friction spinning unit having at least one drivable friction roller defining a yarn formation zone wherein a friction effect is developed for spinning yarn, said roller having an initial surface friction characteristic, comprising:

friction roller surface conditioning means for conditioning said surface, said conditioning means being capable of altering said initial surface friction characteristic.

18. Apparatus according to claim 17, wherein said conditioning means includes an arrangement for the roughening of the outer surfaces of the friction roller.

19. Apparatus according to claim 17, wherein said conditioning means includes an arrangement for the reconditioning and/or application of depression upon the surface of the friction roller.

20. Apparatus according to claim 17, wherein the conditioning means includes an arrangement for polishing the surfaces of the respective friction roller.

21. Apparatus according to claim 17, wherein the conditioning means includes a component part adjustably movable to adjacent the friction rollers, the length of which component part corresponds to the axial length of the friction rollers.

22. Apparatus according to claim 17, wherein the conditioning means includes a component part adjustably movable to the friction rollers, which component is driven in the axial direction of the rollers in a back and forth movement.

23. Apparatus according to claim 17, wherein said conditioning means includes an arrangement for applying a lyaer or coating covering the surfaces of the friction rollers at least in the area of the yarn formation region.

24. An open-end friction spinning machine comprising:

a plurality of adjacently arranged spinning units, each spinning unit including a pair of friction rollers having cylindrical outer surface disposed adjacent one another to form a yarn forming wedge-shaped gap therebetween, common driving means for driving the friction rollers of at least one of the spinning units, and auxiliary drive means for driving the friction rollers of a spinning unit during servicing operations, said auxiliary drive means including an auxiliary drive element directly engageable simultaneously with the outer surfaces of both friction rollers of a respective spinning unit.

25. An open-end friction spinning machine according to claim 24, including servicing means operable at respective spinning units to perform servicing operations.

26. An open-end friction spinning machine according to claim 25, wherein the servicing means is part of a mobile servicing unit which is selectively movable between spinning units, said auxiliary drive element being carried with the mobile service unit.

27. An open-end friction spinning machine according to claim 24, wherein the common driving means has a joint drive element which runs simultaneously against the surfaces of both friction rollers of the respective spinning units.

28. An open-end friction spinning machine according to claim 25, wherein the servicing means is provided with drive interrupting means for interrupting the drive of the friction rollers by detaching the joint drive element from both friction rollers of the respective spinning units.

29. An open-end friction spinning machine according to claim 24, wherein each spinning unit is provided with drive interrupting means for interrupting the drive of the rollers by detaching the joint drive element from both friction rollers of the respective spinning units.

30. An open-end friction spinning machine according to claim 24, wherein a tangential belt is provided as the joint driving means which belt passes through in longitudinal direction of the spinning machine resting against the shell surfaces of both friction rollers of respective spinning units and which, at each spinning unit, is loaded in the direction of the shell surfaces of the friction rollers by means of a tension roll arranged in the plane of the wedge-shaped gap.

31. An open-end friction spinning machine according to claim 30, wherein the tangential belt and the tension roll are arranged on the side of the friction rollers that faces away from the fiber-containing wedge-shaped gap.

32. An open-end friction spinning machine according to claim 24, wherein, as the auxiliary driver element, a friction wheel is provided which can be applied simultaneously to the surfaces of both rollers in the plane of the wedge-shaped gap.

33. An auxiliary drive arrangement for open-end friction spinning machines of the kind having a pair of adjacently arranged friction rollers with cylindrical surfaces, comprising:

an auxiliary drive element for driving the rollers, said drive means being directly engageable simultaneously with the surfaces of said rollers, and a movable auxiliary drive means for selectively moving the auxiliary drive element into driving engagement with both of a pair of friction rollers of a spinning unit.

34. An arrangement according to claim 33, wherein said auxiliary drive element includes disk means having a friction surface engageable with shell surfaces of the friction rollers.

35. An arrangement according to claim 34, wherein said disk means is carried on a movable servicing unit which is selectively movable between spinning units of a spinning machine.

36. An open-end friction spinning apparatus including at least one spinning unit, comprising:

drivable friction surface means defining a yarn formation zone, said friction surface means including at least one rotatable cylindrical roller having a cylindrical friction surface rotatable about an axis of rotation, said yarn formation zone comprising a substantially linear region extending along a line adjacent said surface, said line and said axis of rotation being substantially coplanar, and friction roller conditioning means for conditioning the friction surfaces of at least one of the friction rollers.

37. Apparatus according to claim 36, wherein each spinning unit is provided with said conditioning means for conditioning the surfaces of the friction rollers.

38. Apparatus according to claim 36, comprising a maintenance unit which is movable in the longitudinal direction of the spinning machine to respective maintenance positions adjacent the respective spinning units, said conditioning means being accomodated on the maintenance unit.

* * * * *